United States Patent [19]

Kitabayashi

[11] 4,310,297

[45] Jan. 12, 1982

[54] GAS LIGHTER

[76] Inventor: Seiichi Kitabayashi, No. 919-12, Oaza-koshikiya, Ageo-shi, Saitama, Japan

[21] Appl. No.: 109,153

[22] Filed: Jan. 2, 1980

[51] Int. Cl.[3] ..... F23Q 1/04

[52] U.S. Cl. ..... 431/254; 431/276; 431/343

[58] Field of Search ..... 431/150, 254, 344, 276, 431/277

[56] References Cited

U.S. PATENT DOCUMENTS 3,290,905 12/1966 Court ..... 431/150

3,740,183 6/1973 Piffath ..... 431/254

*Primary Examiner*—Carroll B. Dority, Jr.

*Attorney, Agent, or Firm*—Fulwider, Patton, Rieber, Lee & Utecht

[57] ABSTRACT

A gas lighter comprises a fuel injection pipe member having a main passage and at least one radial lateral passage, a fuel tank for liquefied fuel gas, a valve member made of resilient, flexible material and sealingly surrounding the fuel injection pipe member for selectively preventing the fuel gas from flowing therethrough and allowing the fuel gas to flow therethrough when the valve member is suitably deformed, a spark generating mechanism for generating a spark, having a tubular body, a flint, a spring and a knurled wheel, the spring disposed in a hollow cylindrical space of said tubular body for urging the flint toward the knurled wheel, a windbreak for substantially enclosing the fuel injection pipe member and retaining the spark generating mechanism therein so that the mechanism is movable downwardly against the spring, guide means for assisting the up and down movement of mechanism spark generating, and valve actuating means for deforming the valve member, including a camming surface for tilting the fuel injection member.

8 Claims, 14 Drawing Figures

GAS LIGHTER

BACKGROUND OF THE INVENTION

The present invention relates to a gas lighter. It relates more particularly to a throwaway type liquefied fuel gas lighter which is simply constructed in low cost but has a sufficient function.

In such a gas lighter, it is especially desired that the manufacturing cost is low and a construction is simple. Typically, a gas lighter having a seesaw type valve actuating mechanism has been provided. However, such a prior art throwaway type gas lighter requires various mechanical parts because the seesaw type valve actuating mechanism is very complicated for a throwaway type gas lighter. A design of a prior art gas lighter is unduly limited due to usage of the seesaw type valve mechanism which is rather large in size in particular in its longitudinal direction. Also, for this designing limitation, a shape of a fuel tank is limited to a rectangular receptacle. Further, in the prior art lighter, the fuel is accidentally leaked through a valve mechanism in a user's pocket. This is very dangerous.

SUMMARY OF THE INVENTION

In view of the above-noted defects, an object of the present invention is to provide a throwaway type gas lighter which is very simple in construction.

Another object of the present invention is to provide a throwaway type gas lighter a configuration of which is freely designed due to a usage of a simple compact valve mechanism.

Another object of the present invention is to provide a throwaway type gas lighter suitable for a mass-production at low cost.

Still another object of the present invention is to provide a throwaway type gas lighter having a novel fuel flow adjusting means and an accidental fuel supply preventing mechanism. It is easy to handle or operate the lighter according to the invention.

The foregoing and other objects are achieved by providing a throwaway type gas lighter comprising a fuel injection pipe member having a main passage and at least one radial lateral passage, a fuel tank or reservoir, a valve member made of rubber like material and sealingly surrounding the fuel injection pipe member, a spark generating mechanism a wind-break for substantially enclosing the fuel injection pipe member and retaining the spark generating mechanism therein so that the mechanism is movable downwardly against a spring, guide means for assisting the up and down movement of the mechanism, and valve actuating means for deforming the valve member.

According to the present invention, there is provided a gas lighter having deformable elastic plug means for opening and closing a fuel passage thereby simplifying the construction, ensuring the operation and being capable of supplying a liquefied gas through a top end of a fuel injection pipe. Further, the invention exhibits a feature that a upright member used as spark generating means is readily designed to be slidably retained along rear bent split edges and urged upwardly by the action of a spring, thereby reducing the number of mechanical parts therefor. Such gas lighter can be manufactured in low cost.

BRIEF DESCRIPTION OF THE DRAWINGS

The present invention will be hereinafter described in reference to the accompanying drawings, in which.

DESCRIPTION OF THE PREFERRED EMBODIMENT

Figure 1:
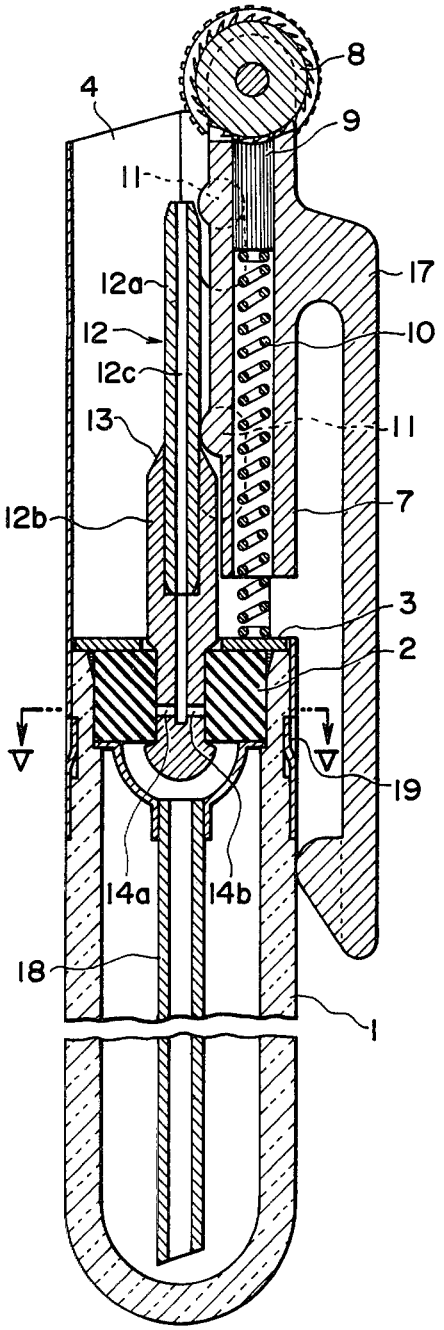
FIG. 1 is an in-part fragmentary cross-sectional view of a first embodiment of a gas lighter according to the present invention.

FIG. 1 shows a first embodiment of a gas lighter such that when liquefied fuel is completely consumed it will be thrown away. A longitudinal cylindrical fuel tank or reservoir 1 is made of hard transparent resin or the like. A plug or valve member 2 made of soft resilient materials such as rubber is inserted at an upper opening of the tank 1 and secured thereto by a metallic disc 3 with adhesives therebetween.

Figure 4:
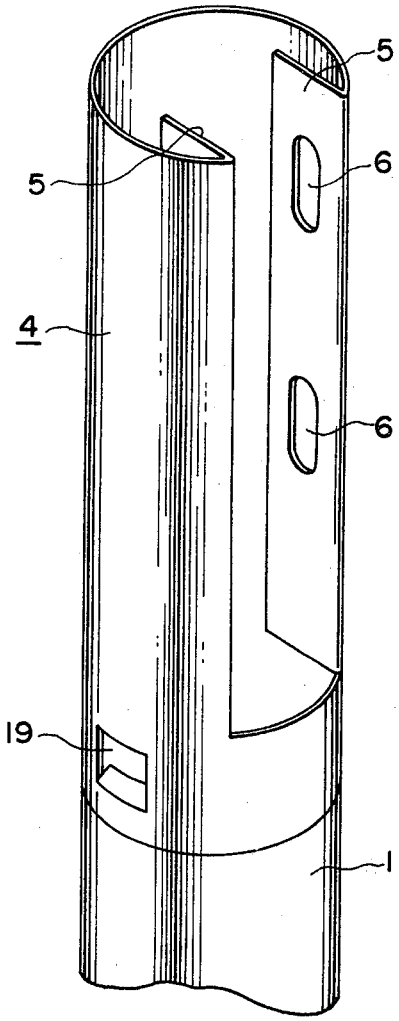
FIG. 4 is a perspective view of a windbreak of the gas lighter.

A cylindrical metallic windbreak 4 is rotatably mounted on an outer periphery of the fuel tank 1 but prevented from moving up and down by a hook portion 19. As best shown in FIG. 4, a rear part of the windbreak is cut and folded inwardly to form a pair of guide edges 5 in which a plurality of oblong holes 6 are formed for retaining slidably up and down an upright member 7 described later.

Figure 3:
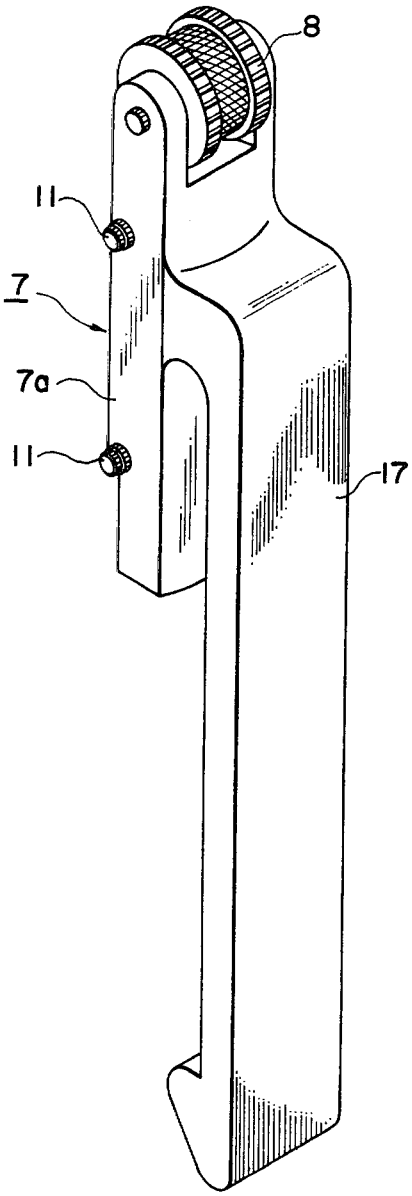
FIG. 3 is a perspective view of a spark generating mechanism of the gas lighter.

As best shown in FIG. 3, the upright member 7 includes a substantially tubular pipe **7*a* made of metal or synthetic resin and having a pocket clip 17, a knurled wheel 8 coaxially retained thereto, a flint 9 disposed within the tubular pipe and a compression spring 10 for pushing the flint toward the knurled wheel 8. A plurality of projections 11 each extending from both side walls of the tubular pipe 7*a* are slidably engageable with oblong holes 6 formed in the inwardly bent portions 5 of the windbreak 4. Thus the upright member 7** is urged to move upward by the action of the compression spring in assembly.

An injection pipe 12 consists of an upper injection pipe **12*a* and a lower injection pipe 12*b* coupled thereto. An annular slanted surface 13 is formed on an upper portion of the lower injection pipe 12*b* in order to cammingly abut to the projection 11 projected inwardly from the tubular pipe 7. A fuel passage 12***c* is formed in the fuel injection pipe 12 and communicates with a pair of horizontal radial passages 14*a* and 14*b* at a lower portion of the lower injection pipe 12*b*. It is preferable that the radial passages are diametrically aligned. The radial passages 14*a* and 14*b* are closed by a rubber plug member 2. Reference numeral 18 denotes a fuel supply pipe.

Figure 2:
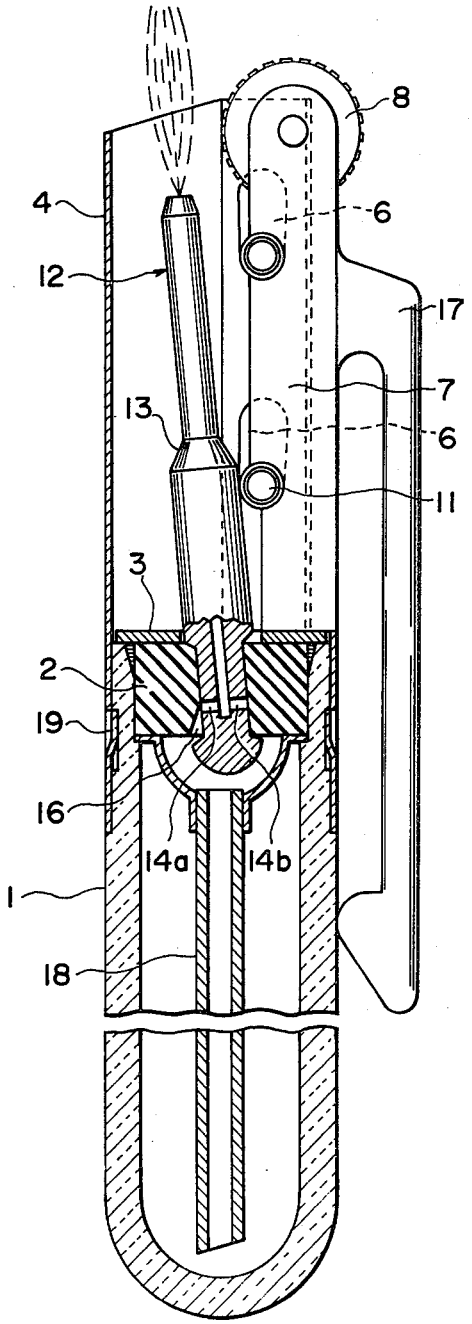
FIG. 2 is a similar view showing another state.

The thus constructed lighter will operated as follows. When the knurled wheel 8 is rotated and at the same time the upright member 7 is lowered by thumbing action, the upright member is lowered against the spring 10 and the projection 11 is lowered while abutting against the annular slanted portion 13 to thereby tilt the fuel injection pipe 12 as shown in FIG. 2. A front upper portion, implanted in the plug 2, of the lower injection pipe 12*b* pushes the front upper portion of the plug 2 forwardly whereas a rear lower portion, implanted in the plug 2, of the lower injection pipe 12*b* pushes the rear lower portion of the plug 2 rearwardly. Thus the flexible plug 2 is deformed to create a gap 16 which allows the radial passages 14*a* and 14*b* and the inner chamber of the fuel tank to be in fluid communication. Then, gasified fuel continuously rises from the inner chamber of the fuel tank to the passages in the fuel injection pipe through the gap while the upright member 7 is lowered and retained at low level.

Figure 5:
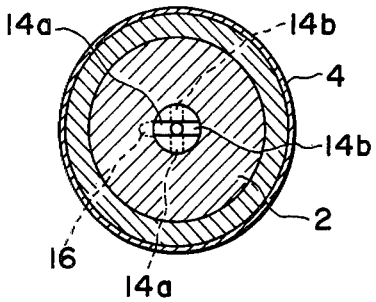
FIG. 5 is a cross-sectional view taken along the line V—V of FIG. 1.

In this case, when the fuel tank is relatively rotated with respect to the windbreak, the injection pipe is rotated together with the plug 2 while the upright member 7 is not rotated since the upright member 7 is engaged with the windbreak. With such a construction, a fuel supply adjustment can be achieved by rotating the fuel tank with respect to the windbreak to some extent. When the fuel tank 1 is further rotated by a right angle and the radial passages 14*a* and 14*b* are rotated to the position shown in FIG. 5 by dotted lines, the fuel supply is cut. In this case, even if the upright member is retained at the low level, it is impossible to supply gasified fuel to the tip of the fuel injection pipe. Therefore, this mechanism is used as safety means.

Figure 6:
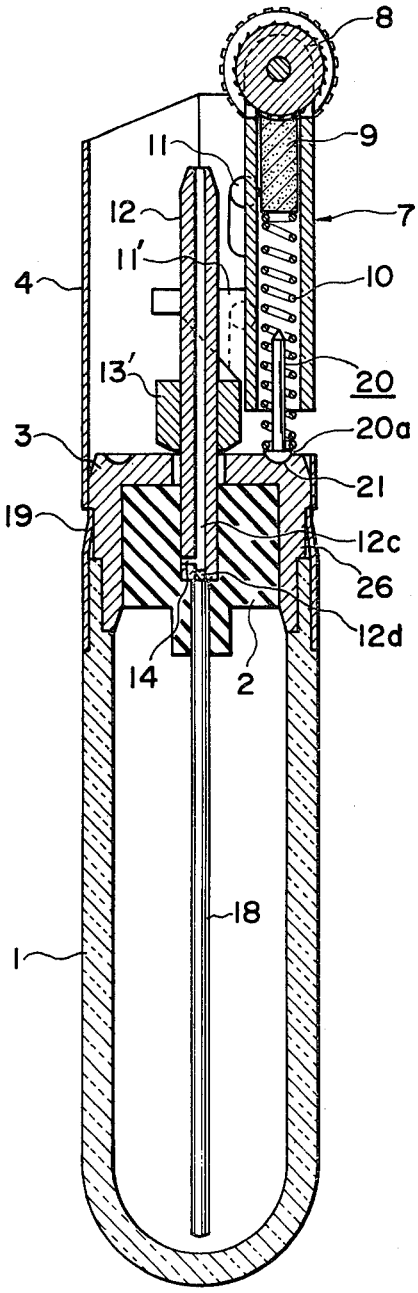
FIG. 6 is a cross-sectional view of a second embodiment of a gas lighter according to the present invention.

FIG. 6 shows another embodiment of the invention. In this embodiment, more precise adjustment of flame can be obtained. In FIG. 6, like members are designated by the same reference characters used in the first embodiment. A cap-shaped member 3 made of hard synthetic resin or metal is inserted into an upper opening portion of a fuel tank 1. A deformable valve member 2 made of rubber or the like is fixedly inserted into a cavity of the cap-shaped member 3. A single tubular fuel pipe 12 is implanted in the valve member 2 through an opening formed in a central portion of the cap member 3. The fuel injection pipe 12 is clogged at its lower end, for example, by hard solder 12*d* and at the same time provided with a single lateral hole 14 extending radially. Instead of the solder 12*d*, the pipe 12 may be made integrally with a bottom portion at 12*d*. A porous sheet 18*a* is disposed in a bottom of hole formed in the valve member. A fuel suction fibrous member 18 is inserted into the valve member 2. Fuel will be sucked through the fibrous member 18 and the porous member 18*a*.

In the same manner as in the previous embodiment, a windbreak 4 is rotatably coupled to an upper portion of the fuel tank 1 and the cap member 3. The cap member is provided with a shouldered portion 26 on the side wall as shown in FIG. 7, and the windbreak is prevented from moving up and down by the engagement of the shouldered portion 26 and a hooked portion 19 formed in the windbreak 4.

In substantially the same manner as in the previous embodiment, a spark mechanism 7 includes a tubular body, a flint 9, a knurled wheel 8, a compression spring 10 and a plurality of projections 11. However, the spark mechanism has no pocket clip. It should be noted that in this embodiment there are provided a pair of second projections 11' integral with the tubular body of the spark mechanism 7, the second projections each having a camming surface for abutting against the member 13' secured to an intermediate portion of the injection pipe so that the fuel injection pipe 12 can be inclined by the downward movement of the spark mechanism 7.

Figure 7:
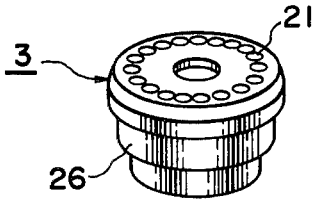
FIG. 7 is a perspect view showing a cap member of the second gas lighter.

In addition, in this embodiment, a precise flame adjustment mechanism is as shown in FIG. 7, composed of a pin 20 having a hemispherical flanged portion 20*a* at its lower end and a number of concave portions to be engaged with the flanged portion 20*a* of the pin 20, the pin being alinged along the center line of the tubular body of the spark mechanism so that the pin 20 is urged to move downward. Thus the compression spring 10, pin 20 and the concave portion form a clickstop mechanism for accurate adjustment of flame.

Figure 8:
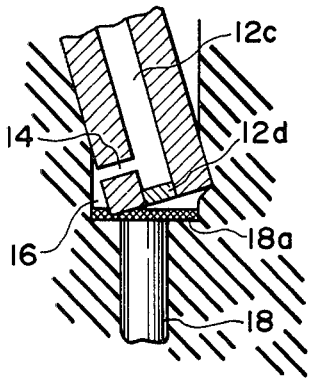
FIG. 8 is an enlarged cross-sectional view at the fuel gas communicating gap in the second gas lighter.

The thus constructed gas lighter will be operated as follows. The operation thereof is substantially the same as the previous gas lighter. When no force is applied to the knurled wheel 8, a spark mechanism is at high level with the projections 11 contacted with upper edges of the holes 11. On the other hand, when the user's thumb rotates the knurled wheel 8, the whole spark mechanism 7 will be lowered so that the member 11' pushes the member 13' of the fuel injection pipe 12 to thereby tilt the fuel injection pipe 12. As a result, a gap 16 is formed as shown in FIG. 8 and a liquefied fuel rising to the upper end of the suction member 18 is gasified and introduced into the passage 12*c* of the fuel injection pipe through the gap 16. In this case, the amount or rate of the fuel to be supplied through the radial hole 14 is controlled by the slant direction of the fuel injection pipe 12, the direction being determined by the engagement of a plurality of concave portions 21 and the flanged portion 20*a*. The concave portions 21 are formed in the upper surface of the cap member 3 in a concentric circle. The slant direction of the fuel pipe 12 can be readily and positively changed by rotating the fuel tank with respect to the windbreak which holds the spark mechanism.

It is to be noted that in the above described adjustment mechanism, the fuel injection pipe is fixed relative to the valve or plug member 2, and so the positive sealing effect can be achieved in comparison with the case where the fuel injection pipe is rotated relative to the valve or plug member.

Figure 9:
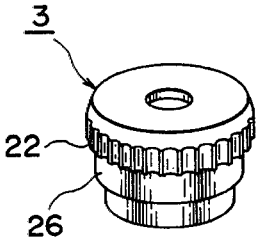
FIG. 9 is a perspective view of another cap member of a third embodiment according to the invention.
Figure 10:
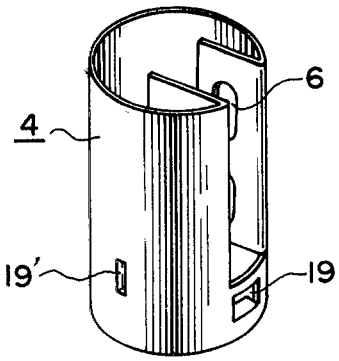
FIG. 10 is a perspective view of an associated windbreak.
Figure 11:
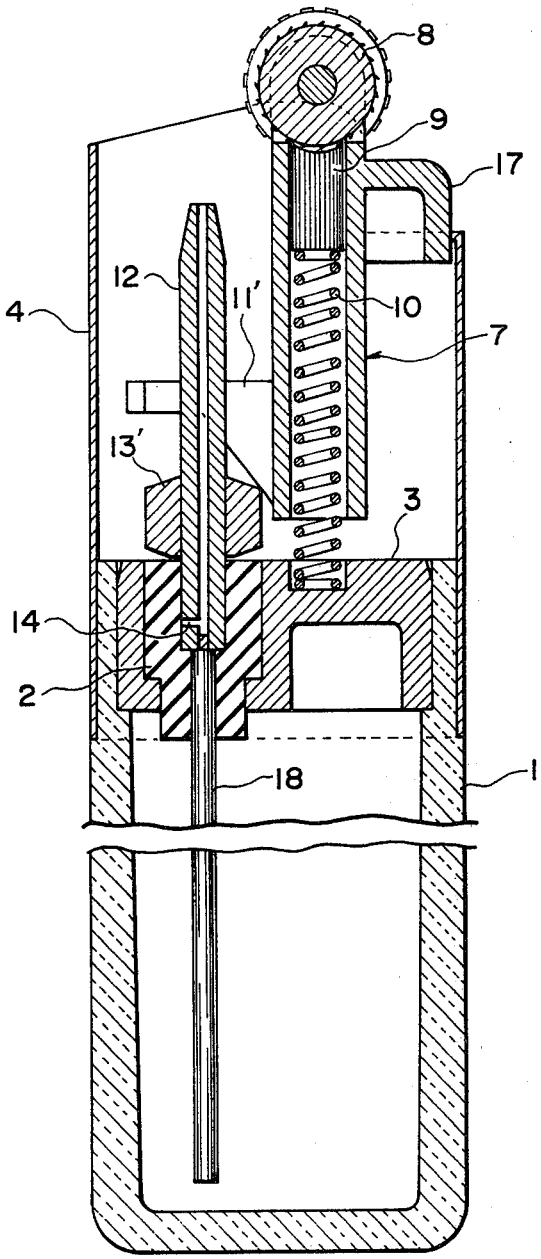
FIG. 11 is a fragmentary cross-sectional view showing a gas lighter of a fourth embodiment according to the present invention.
Figure 12:
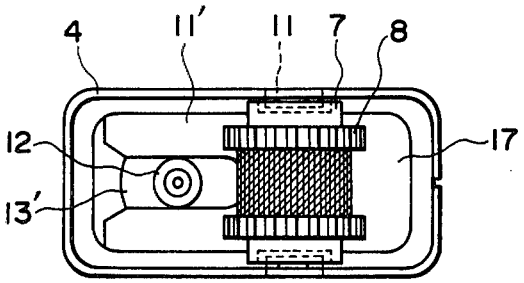
FIG. 12 is a plan view of the gas lighter shown in FIG. 11.
Figure 13:
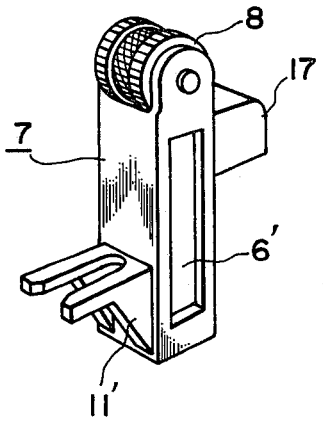
FIG. 13 is a perspective view of the spark generating mechanism shown in FIG. 11.
Figure 14:
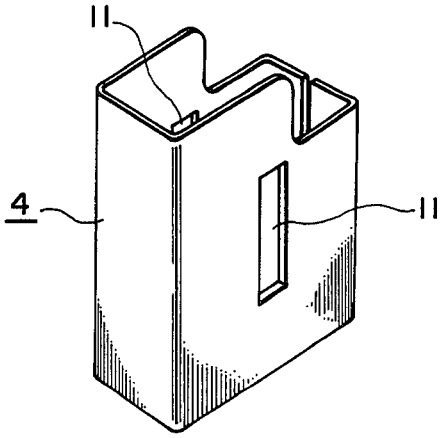
FIG. 14 is a perspective view of the windbreak shown in FIG. 11.

FIG. 9 and 10 show still another embodiment concerning the flame adjustment mechanism which is more simplified in construction. The cap member 3 is provided with a shouldered side walls 26 and 22. The upper side wall 22 is corrugated so that a plurality of projections can be formed thereon. One of the projections is engageable with a hole 19' formed on the windbreak 4 as shown in FIG. 10. It is obvious that the operation is the same as the previous embodiments.

It should be noted that in these embodiments the concave portions 21 or the corrugations 22 are formed on the cap member which is an individual mechanical part, and it is, therefore, easy to manufacture the flame adjusting mechanism.

FIGS. 11 to 14 shows still another embodiment according to the invention. In this embodiment, the flame adjustment mechanism is dispensed with. For this, the mechanism is more simplified to be thereby capable of obtaining a positive operation. The number of movable mechanical ports are further reduced. The gas lighter of this embodiment is substantially rectangular. The cap member 3 is made of hard synthetic resin or metal and an elastic resilient member 2 made of rubber or the like is inserted into an opening of the cap member 3. It is obvious that the fuel injection system and the spark mechanism are constructed as in the preceding embodiments.

In this embodiment, a pair of inwardly projected portions 11 are provided on the side walls of the windbreak 4. The guide grooves 6' are formed in the body of the spark mechanism body. The spark mechanism body can be manufactured by integrally molding.

What is claimed is:

1. A gas lighter comprising:

a fuel injection pipe member having a main passage and at least one radial lateral passage communicating to the main passage, a fuel tank for liquefied fuel gas, a valve member made of resilient, flexible material and sealingly surrounding said fuel injection pipe member for selectively preventing the fuel gas from flowing therethrough and allowing the fuel gas to flow therethrough when said valve member is suitably deformed, a spark generating mechanism for generating a spark, having a tubular body, a flint, a spring and a knurled wheel, said spring disposed in a hollow cylindrical space of said tubular body for urging said flint toward the knurled wheel, a windbreak for substantially enclosing the fuel injection pipe member and retaining said spark generating mechanism therein so that said mechanism is movable downwardly against said spring, guide means for assisting the up and down movement of said spark generating mechanism, and valve actuating means for deforming said valve member, including a camming surface for tilting said fuel injection member.

2. A gas lighter as defined in claim 1, further including fuel supply amount adjustment means for adjusting the flow amount of the fuel gas passing through said fuel injection member wherein said windbreak is substantially cylindrical and rotatably mounted on the fuel tank.

3. A gas lighter as defined in claims 1 or 2, wherein said camming surface is formed around an outer periphery of the fuel injection pipe member and an associated projection is formed at a corresponding position of said spark generating mechanism, whereby when said mechanism is depressed against the spring the fuel injection pipe member is tilted thereby allowing the fuel gas to pass through the valve member.

4. A gas lighter as defined in claims 1 or 2, wherein said camming surface is formed around said spark generating mechanism and an associated projection is formed at a corresponding position of the fuel injection pipe member, whereby when said mechanism is depressed against the spring the fuel injection pipe member is tilted thereby allowing the fuel gas to pass through the valve member.

5. A gas lighter as defined in claim 2, further comprising a cap member for surrounding the valve member and the fuel injection pipe member, said cap member fixedly secured to the valve member and an upper end of the fuel tank.

6. A gas lighter as defined in claim 5, wherein a pin having a hemispherical head is provided in the spring, and a plurality of associated concave portions are formed in an upper surface of the cap member to thereby form a click-stop.

7. A gas lighter as defined in claim 5, wherein a number of corrugated projections are formed on the side surface of the cap member, and an associated slot is formed in the windbreak.

8. A gas lighter as defined in claim 1, wherein said windbreak is substantially rectangular in cross-section.

* * * * *